US006320271B1

(12) United States Patent
Hill et al.

(10) Patent No.: US 6,320,271 B1
(45) Date of Patent: Nov. 20, 2001

(54) POWER GENERATION SYSTEM AND METHOD OF CONSTRUCTION

(75) Inventors: Ross K. Hill, Houston; Paul J. Grimes, Katy; Charles E. Lawrence, Houston, all of TX (US)

(73) Assignee: Canatxx Energy, L.L.C., Houston, TX (US)

( * ) Notice: Subject to any disclaimer, the term of this patent is extended or adjusted under 35 U.S.C. 154(b) by 0 days.

(21) Appl. No.: 09/598,182

(22) Filed: Jun. 21, 2000

(51) Int. Cl.[7] ..... B60L 1/02
(52) U.S. Cl. ..... 290/2; 290/52; 248/677
(58) Field of Search ..... 290/52, 1 A, 2, 290/1 R; 248/678, 679, 677; 60/670, 39, 31; 405/229

(56) References Cited

U.S. PATENT DOCUMENTS

| | | | | |
|---|---|---|---|---|
| 2,511,854 | * | 6/1950 | Kane | 290/52 |
| 2,531,178 | * | 11/1950 | Nest | 60/687 |
| 2,697,790 | * | 12/1954 | Kirkpatrick | 290/52 |
| 2,733,029 | * | 1/1956 | Griffith | 248/676 |
| 3,150,267 | * | 9/1964 | Caldwell | 290/2 |
| 3,296,450 | * | 1/1967 | Johnson | 290/2 |
| 3,434,529 | * | 3/1969 | Daltry | 165/47 |
| 3,488,960 | * | 1/1970 | Kirkpatrick | 60/686 |
| 3,653,316 | * | 4/1972 | Moline | 454/236 |
| 4,036,021 | * | 7/1977 | Kelp | 60/692 |
| 4,399,657 | * | 8/1983 | Berry | 60/664 |
| 4,964,190 | * | 10/1990 | Murata et al. | 15/369 |

FOREIGN PATENT DOCUMENTS

98/15778 * 4/1998 (WO) .

* cited by examiner

*Primary Examiner*—Joseph Waks
(74) *Attorney, Agent, or Firm*—The Matthews Firm; William P. Remey, III

(57) ABSTRACT

The present invention is an improved power generation facility and method of construction. The improved power generation facility of the present invention provides a low impact implementation suitable for placement in or near a developed, populated area comprising ultimate consumers. The improved power generation facility comprises a foundation; a plurality of legs which form a support structure capable of supporting a plurality of condenser modules with cooling fans of predetermined size; and a housing for containing predetermined power generation equipment, the housing fitting inside the support structure and having a facade which can be made to blend into a surrounding environment's architecture. In a preferred mode, the legs are tricolumn legs that may be removably fastened to each other and to the foundation. Further, the housing may be suspended from the support structure and the plurality of cooling fans situated to minimize noise from the cooling fans. An improved method of constructing the improved power generation facility is also described.

63 Claims, 16 Drawing Sheets

POWER GENERATION SYSTEM AND METHOD OF CONSTRUCTION

TECHNICAL FIELD

The present invention comprises an improved power generation facility and method of constructing the improved power generation facility. More specifically, the present invention comprises an improved power generation facility and method of constructing the improved power generation facility for power generation facilities appropriate for providing incremental power to a power distribution network on demand.

BACKGROUND ART

Current power generation facilities are constructed with maximum power output in mind, i.e. the machinery is designed first and the structures housing the machinery last. Further, in the prior art, foundations for the power generation equipment are typically set and the power generation equipment installed onto the foundation before the surrounding structures such as walls and roofs are constructed. Prior art power generation facility structures and appearances are utilitarian and designed without regard for appearance or blending into an urban architectural style.

Additionally, due to the size of the machines involved and the amount of energy to be generated, power generation facilities of the prior art tend to be large and built far away from the ultimate consumers who will use the power generated. These large power generation facilities tend to be economically viable only when operated at a more-or-less constant output level and are not easily adaptable to varying power generation in response to varying power load requirements of ultimate consumers of the power.

Due to changing market conditions and erratic swings in prices of raw fuels and power, spot markets have developed for power where prices may substantially rise because of a lack of fuel or power and in which at other times prices plunge because of an over supply.

Accordingly, current design power facilities are not appropriate for placement in urban settings. Further, current design criteria force construction of larger plants intended to serve a great number of ultimate consumers who are usually located at some distance from the power generation facility. Further still, many large power generation facilities require extensive use of water, either as a coolant or, in the case of hydroelectric plants, a propellant. Moreover, current design power facilities are not appropriate for cycling power generation in response to cycling power needs.

Additionally, a movement is currently underway to provide and/or increase competition among power generation entities. This competition, in turn, will provide impetus for the construction of new, cost efficient power facilities. There is, therefore, a need for new, cost efficient power generation facilities, especially power generation facilities that can be brought online or taken offline or otherwise vary their power output in an economically viable manner.

Large power generation facilities are often powered by higher cost fuels such as pipeline quality natural gas. Gas pipeline delivery systems are often dispersed in and through urban or other population centers in part because these centers were rural forty to fifty years ago but have become urban over time. However, large power generation facilities cannot utilize many of these gas delivery systems because the gas is either of a lower quality or otherwise uneconomic, e.g. gas cost are too high to be used profitably or sufficient quantities of gas are not available.

Accordingly, it is an objective of the present invention to provide an improved power generation facility appropriate for construction at and operation within an urban setting.

It is a further objective to provide a method of constructing an improved modular power generation facility.

Accordingly, an improved power generation facility and method of constructing the improved power generation facility are described.

SUMMARY OF THE INVENTION

In a preferred embodiment, the current invention comprises an improved power generation facility comprising a foundation of a predetermined size; a central exhaust manifold; a plurality of legs, each leg being securably fastened to at least one other leg and to the foundation, the legs forming a support structure; one or more condenser bays, each condenser bay further comprising at least one cooling fan, the condenser bays being supported by the support structure; power generation equipment of a predetermined size, the power generation equipment being capable of interfacing with a power distribution system, the power generation equipment further capable of utilizing a fuel source to generate power; and a housing of a predetermined size for containing the power generation equipment, the housing being suspended from the support structure, the housing further comprising at least one configurable facade. The power generation equipment may be capable of being economically cycled on and off to meet peak or other cyclic power demands.

In a preferred embodiment, the improved power generation facility is a low impact power generation facility to be constructed in or near a developed, populated area comprising ultimate consumers of power from the power generation facility, and the configurable facade is constructed having an architectural appearance substantially similar to an architectural appearance in the developed, populated area comprising ultimate consumers of power from the power generation facility.

In a further preferred embodiment, the improved power generation facility of the present invention comprises a plurality of modular power generation facilities, each modular power generation facility further comprising a standardized foundation of a predetermined size; at least one standardized condenser bay, each condenser bay comprising at least one cooling fan of a predetermined size; a standardized support structure comprising a plurality of standardized legs, each leg being securably fastened to at least one other leg and to the foundation, the support structure capable of supporting the at least one standardized condenser bay; power generation equipment of a predetermined size, the power generation equipment being capable of interfacing with a power distribution system, the power generation system further capable of utilizing a fuel source to generate power; and a standardized housing for containing the power generation equipment, the housing being suspended from the support structure, the housing further comprising at least one configurable facade.

The legs in a preferred embodiment are tricolumn legs.

A preferred method for the present invention comprises the steps of sizing one or more power generators to provide power appropriate for ultimate consumers of power from the improved power generation facility; obtaining permits for construction of the power generation facility; and constructing the power generation facility to provide a predetermined power generation output.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

GENERAL DESCRIPTION AND PREFERRED MODE FOR CARRYING OUT THE INVENTION

Power generation facilities located within urban settings in or near urban centers have advantages over large, remote power generation facilities. However, power generation facilities are not currently located in or near urban centers for numerous reasons including aesthetic, environmental including noise issues, local approval, and economic reasons.

The present invention's improved power generation facility, generally referred to by the number "1," embodies a modular approach to the creation of power generation facilities for use as improved power generation facilities 1 that are well suited for placement in urban settings. Further, the present invention's improved power generation facility 1 is also well suited for being brought online and taken offline or otherwise varying its power generation on a demand basis while remaining economically viable.

Modular construction of the present invention's improved power generation facility 1 may be accomplished by utilizing standardized designs in accordance with the present invention's teachings for improved power generation facilities 1. These improved power generation facilities 1 may have a physical size smaller than more remotely located power generation facilities. Further, the improved power generation facility of the present invention places less demand on local services such as water resources than conventional power generation facilities.

Moreover, in general, all power generation facilities require federal, state, and/or local governmental permits to be constructed and to operate. Most permits encompass air and water quality and usage permitted levels. In urban settings, these governmental permits may be different and further include noise, architectural, and visual requirements as well as zoning and other local ordinances. Further still, local residents' approval may also be required, at least on a political level.

Improved power generation facility 1 of the present invention is designed to configurably adhere to these permits and regulations and ease obtaining local community-based approval and support, e.g. on a political basis. By way of example and not limitation, these permits and regulations may include or arise from legislated requirements such as those found within United States Electric Utilities Act (16 U.S.C. §824) or United States Public Utility Regulatory Policies Act (16 U.S.C. §2601).

Figure 1:
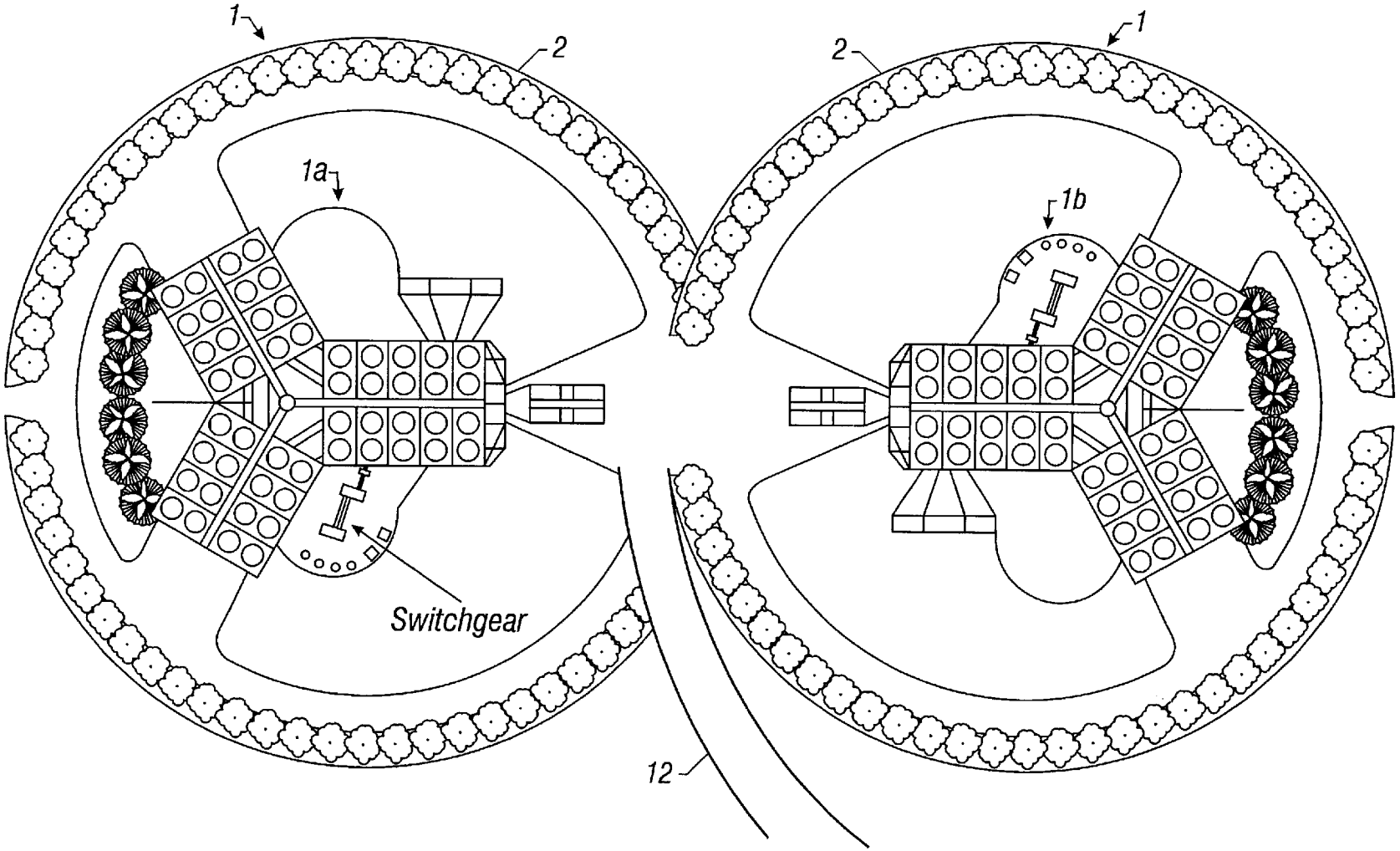
FIG. 1 is a plan view of a representative configuration showing two power generation modules arranged as a single facility.

Referring generally to FIG. 1, a plan view of a representative configuration of two power generation modules configured to operate as a single facility, in a preferred embodiment power generation facility 1 is modular to allow incremental provision of electrical power generation capacity at a given physical location. By way of example and not limitation, power generation facility 1*a* may be the first constructed at a site and power generation facility 1*b* may be constructed at that site at a later date to create additional, incremental power appropriate for desired output. This modularity may further allow incremental additions of additional, highly similar power generation facilities 1 at one or more physical locations to achieve greater power capacity if and as necessary. In addition to configurable facades (not shown in FIG. 1), power generation facility 1 may be surrounded by visual and/or audio barriers 2 such as vegetation, including by way of example and not limitation trees and shrubs, walls, natural hills, or any combination thereof.

Figure 2:
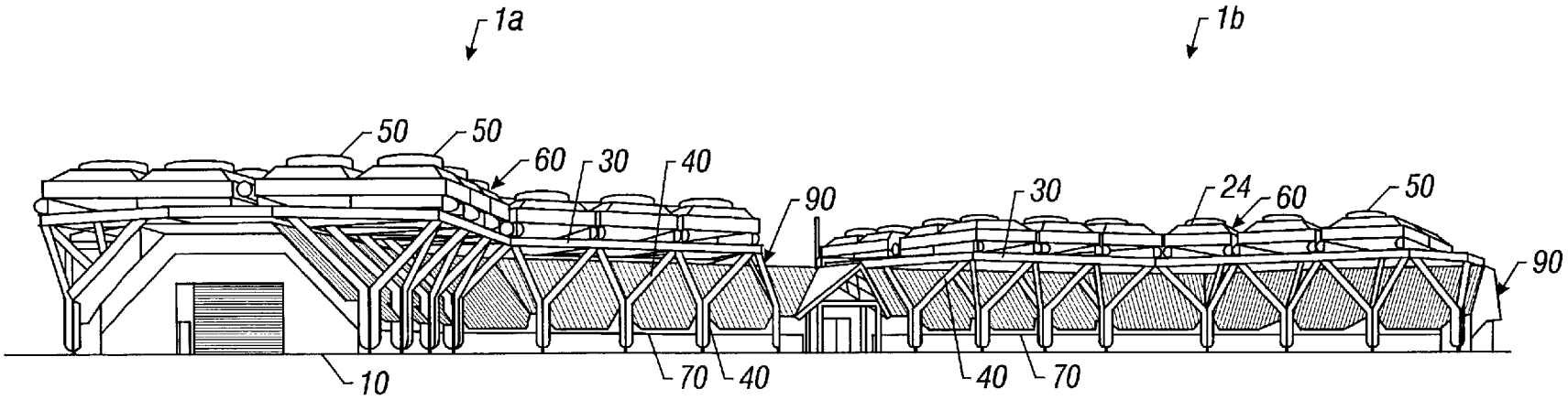
FIG. 2 is a perspective view of a representative configuration of two modular power generation facilities.

Referring now to FIG. 2, a plan view of a representative configuration of two modular power generation facilities, as detailed further herein below, in a preferred embodiment tricolumn legs 40 are securably attached to foundation 10 and allow for onsite construction of support structure 30, the support structure 30 comprising tricolumn legs 40 and providing support for mounting condenser bays 55. Attachment of tricolumn legs 40 may be by any means such as use of bolts and nuts or riveting or the like, thus limiting or removing the need for onsite welding. In the preferred embodiment, components are either constructed at the site, such as foundation 10, or assembled on site, such as support structure 30 which may be bolted together onsite.

Figure 3:
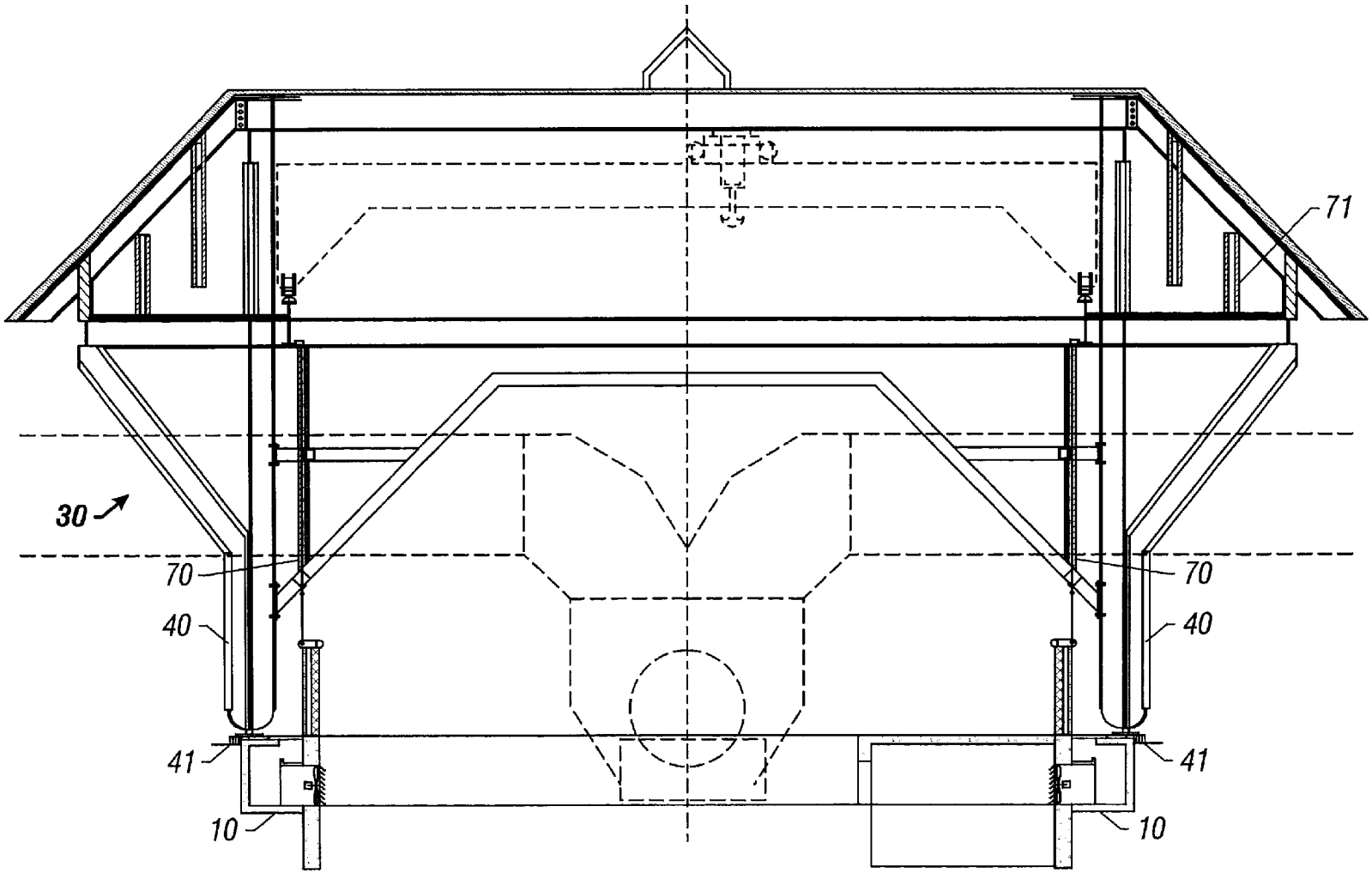
FIG. 3 is a side plan view of a typical side.

Referring now to FIG. 3, a side plan view of a typical side, in the preferred embodiment, Tricolumn legs 40 are fastened to foundation 10 and to each other to allow modular construction of support structure 30. In the preferred embodiment, bolts and nuts may be used as fasteners, but any kind of fastener including rivets, threaded bolts, and welding or any combination thereof may be used. In the preferred embodiment, tricolumn legs 40 are bolted to support pier 41 and support pier 41 is in communication with foundation 10.

Additionally, each tricolumn leg 40 in the preferred embodiment may be individually adjustable with respect to its height using level means such as jackscrews, adjustable members, shims, and the like, all of which will be familiar to those skilled in the construction and leveling arts. In this manner, the entire support structure 30 may be leveled and present a level support platform irrespective of irregularities in foundation 10.

Further, as more fully described herein, walls 70 and ceiling 71 may be suspended from support structure 30, as in the preferred embodiment. The appearance of walls 70 and ceiling 71 may be tailored to a particular location's architectural requirements, allowing the present invention's improved power generation facility 1 to "blend" into and be integrated with the overall look of the urban setting into which it is placed.

Figure 4:
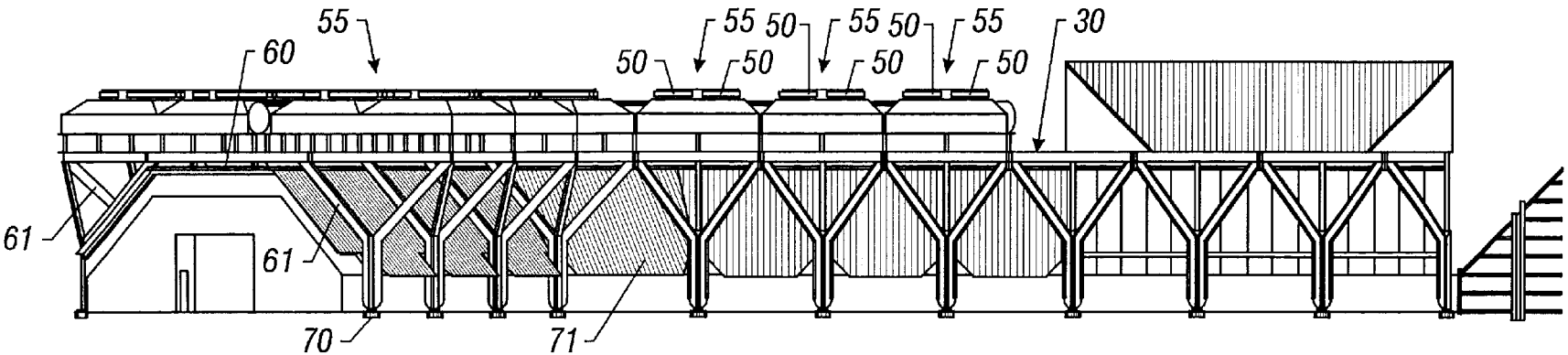
FIG. 4 is an alternate side plan view of a typical side.

Referring now to FIG. 4, an alternate side plan view of a typical side, condenser bays 55 comprise fans 50 and are placed on support structure. Support structure 30, walls 70, and roof 60 are implemented to create air-rise corridor 61 such that improved power generation facility 1 may be at least partially cooled by air flowing through air-rise corridor 61. One air-rise corridor 61 may be present, or, as in the preferred embodiment, at least two air-rise corridors 61 are present per each side of improved power generation facility 1. Further, air-rise corridors 61 act as guide vanes to direct noise attendant to operation of improved power generation facility 1 perpendicularly up and away from improved power generation facility 1. Placement of fans 50 in this manner both ameliorates noise levels and lessens or eliminates the need for coolant water at the improved power generation facility 1.

Figure 5:
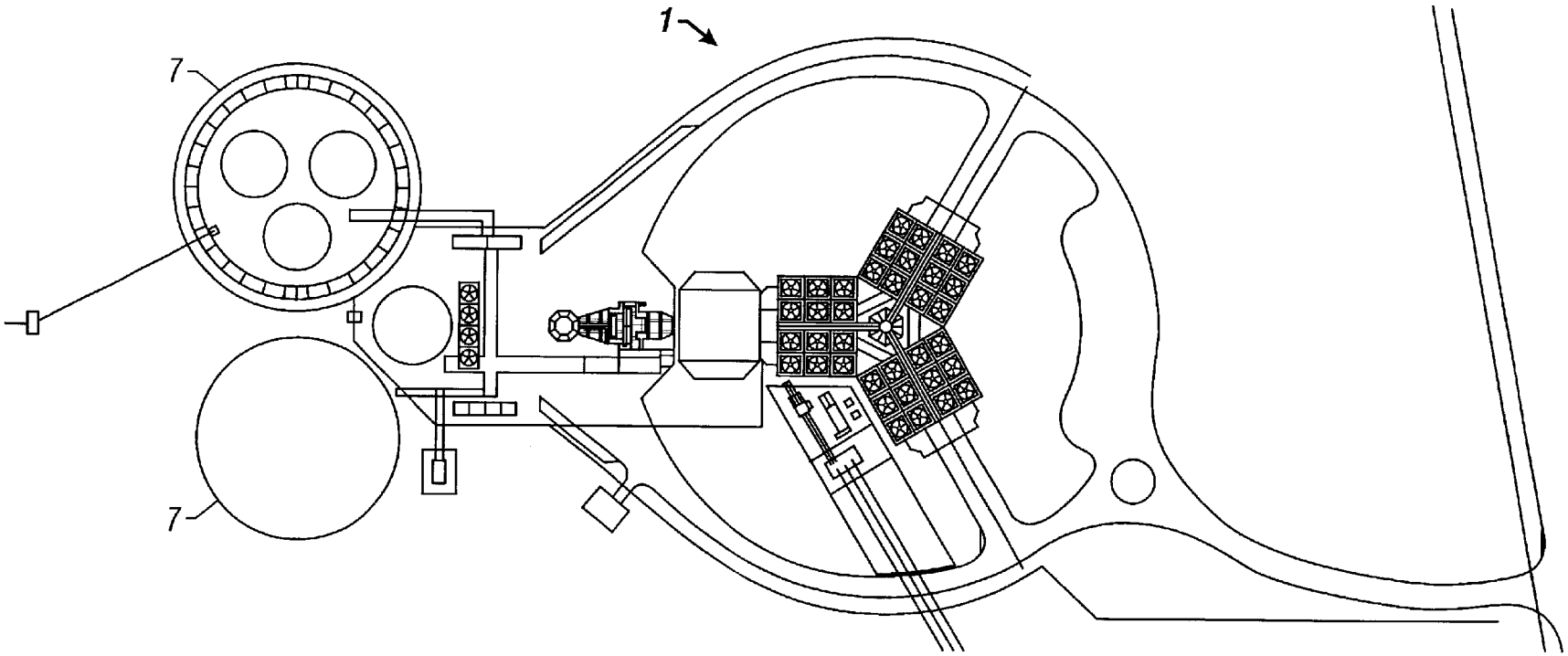
FIG. 5 is a top plan view of an improved power generation facility showing two additional fuel storage tanks.

Referring now to FIG. 5, a top plan view of an improved power generation facility showing two additional fuel storage tanks, because improved power generation facility 1 is modular and sized to a power generation level appropriate for its local ultimate consumers, improved power generation facility 1 may take advantage of use of local power generation materials such as lower quality gas which may be more readily available than pipeline quality gas or other fuels. Improved power generation facility 1 may also take advantage of providing power through lower, so called medium voltage distribution systems already present in the urban setting. To aid in the economic viability of improved power generation facility 1, one or more storage facilities 7 may be constructed or otherwise utilized, allowing operators of improved power generation facility 1 to obtain supplies of fuel when spot or other markets are lower in fuel costs and thereby buffer fuel costs. Storage facilities may include above ground storage tanks, underground storage tanks, tank cars, and the like, or any combination thereof.

Figure 6:
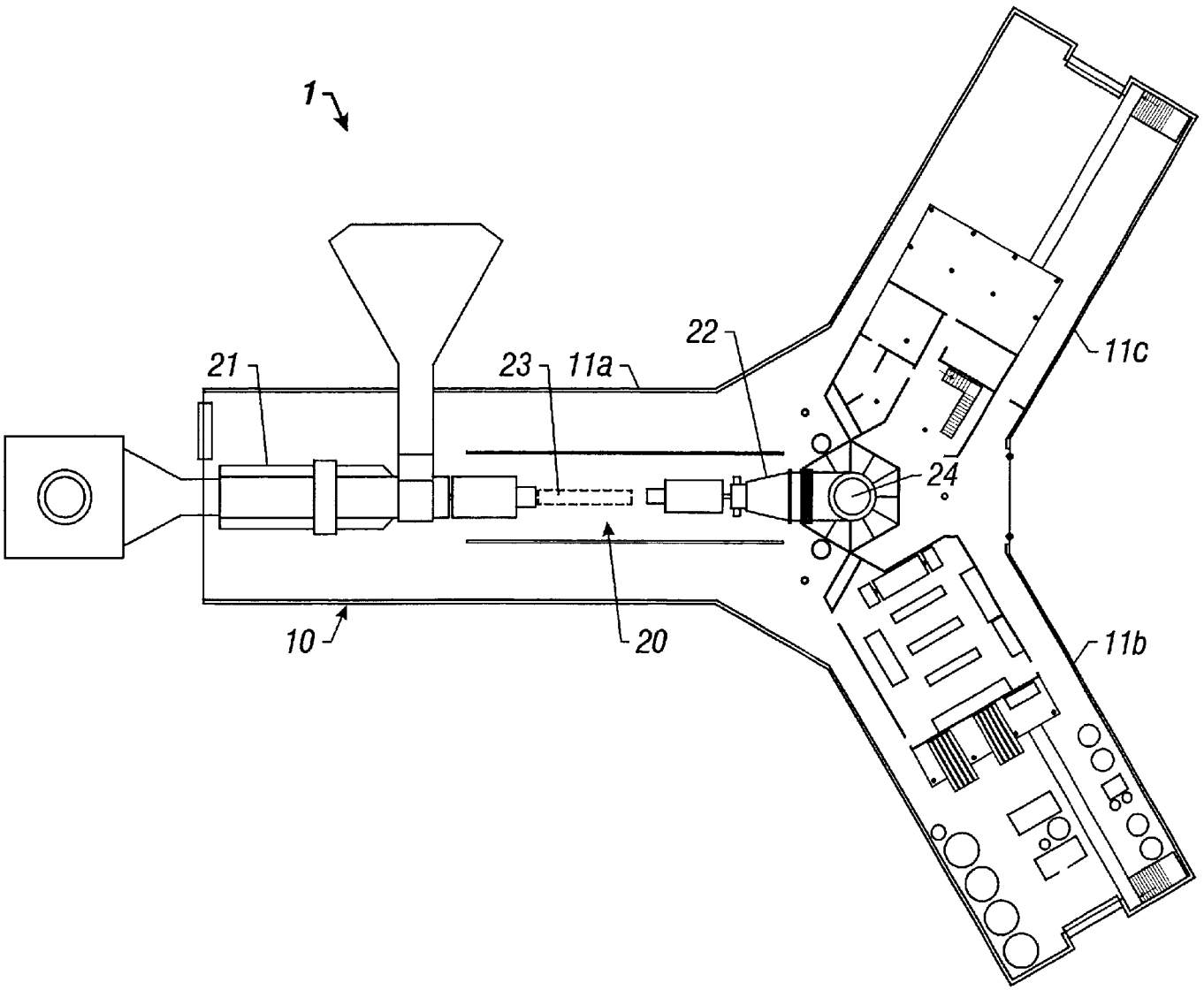
FIG. 6 is a schematic plan view of a representative configuration of a modular power generation facility showing power generation equipment placement.

Referring now to FIG. 6, a plan view of a representative configuration of a modular power generation facility showing power generation equipment placement, foundation 10, in keeping with the modular approach of the present invention, may be constructed in a predetermined shape. In the preferred embodiment, foundation 10 is configured into a modified "Y" shape having three wings, generally referred to herein as "11": power wing 11*a,* electrical gear wing 11*b,* and shop and locker wing 11*c.* Foundation 10 is sized to support power generation equipment 20 capable of supporting the power requirements of power generation facility 1. Further, foundation 10 may be configured to support two or more stories.

In the preferred embodiment, each power generation facility 1 module is sized to house and contain power generation equipment 20 that provides between one hundred to one hundred fifty megawatts. In the preferred embodiment, power generation equipment 20 comprises gas turbine-generator set 21 and steam turbine-generator set 22 that share a common space within power wing 11*a* for pulling one or more rotors 23. Generator set 21 and steam turbine-generator set 22 may be installed along a central portion of power wing 11*a.* In a preferred embodiment, use of natural gas to power gas turbine set 22 promotes low exhaust emissions and high fuel efficiency, even with lower quality natural gas, e.g. gas having lower BTU characteristics. Further, use of gas turbine-generator set 21 and steam turbine-generator set 22 allows power generation equipment 20 to be cycled on or off in a relatively short time with a relatively short lag time between demand and supply of power. This allows improved power generation facility 1 to be used as an auxiliary power generation facility to help a larger power system buffer peak or other cyclic demands.

In a preferred embodiment, one or more overhead bridge cranes (not shown in FIG. 6) may be deployed proximate a center axis of power wing 11*a* to accommodate installation, service, and maintenance of generator set 21 and steam turbine-generator set 22.

Central core manifold 24 provides a means to transport or otherwise route steam used with gas turbine-generator set 21 and steam turbine-generator set 22 to condenser bays 55. In an alternate embodiment, central core manifold 24 may further comprise a multi-channel ported cooler having a plurality of internal conduits or manifolds and at least one conduit or manifold to contain the a plurality of internal conduits or manifolds.

Figure 7:
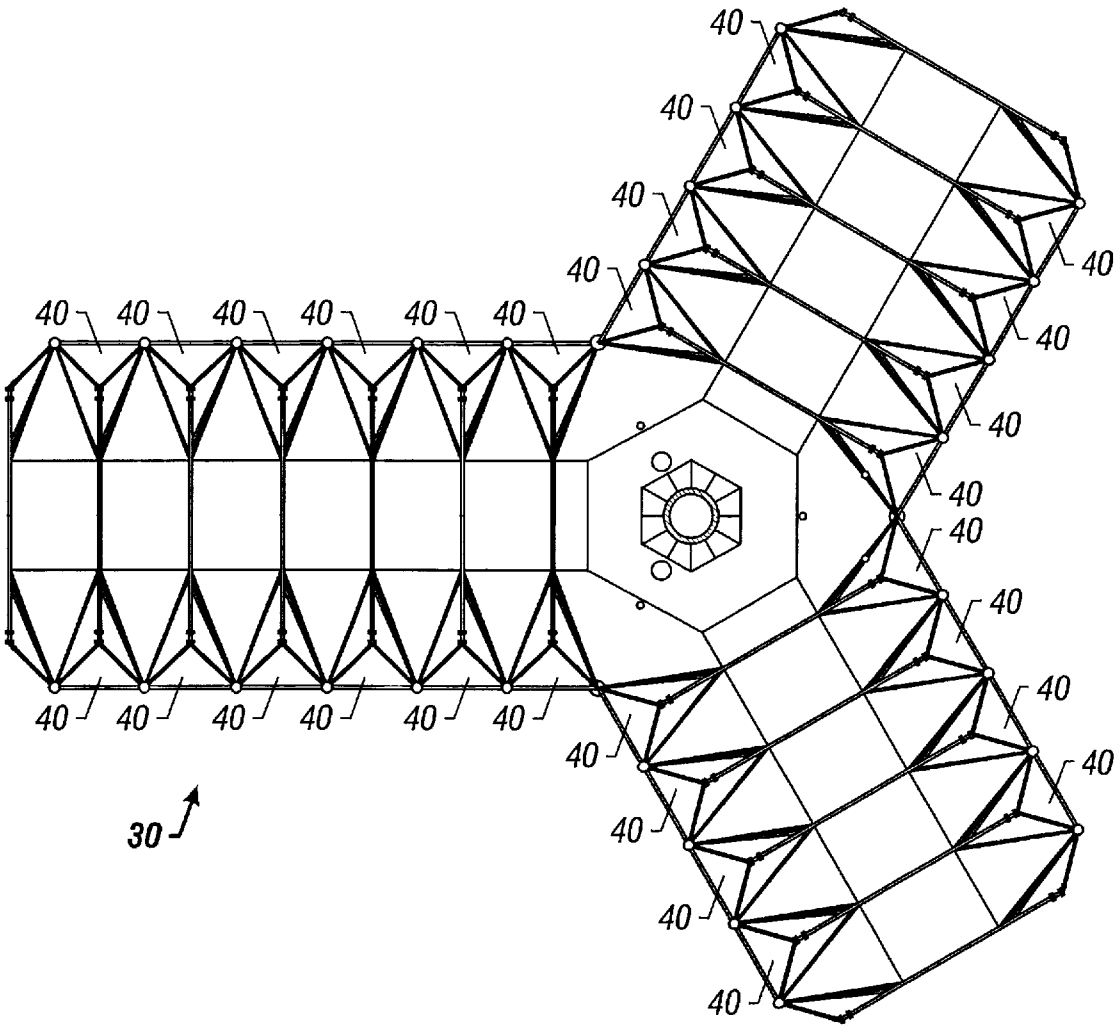
FIG. 7 is a plan view of a representative configuration of power generation facility showing tricolumn legs forming support structure.

Referring now to FIG. 7, a plan view of a representative configuration of power generation facility 1 showing tricolumn legs 40 forming support structure 30, tricolumn legs 40 form support structure 30. The top of support structure 30 is capable of supporting one or more condenser bays 55 (not shown in FIG. 7). In the preferred mode, support structure 30 is assembled from tricolumn legs 40 onsite after foundation 10 is prepared. However, support structure 30 may also be assembled or partially assembled offsite for installation onsite.

Referring now to FIG. 8, a plan view of a representative configuration of power generation facility 1 showing placement of condenser bays 55 with cooling fans 50, condenser bays 55 operate more efficiently when arranged in a pressure equalizing configuration such as in two or more opposing condenser bays 55. In a preferred embodiment, three condenser bays 55, comprising one or more condenser modules 56, radiate symmetrically from central core manifold 24 and are deployed one per wing 11. Use of condenser bays 55 reduces the length of steam manifold 57 and pressure losses while insuring a balanced load on each condenser module 56.

In a preferred embodiment, one or more cooling fans 50 are integral with condenser modules 56 and condense air used for cooling power generation equipment 20. In the preferred embodiment, two cooling fans 50 are present in each condenser module 56. Use of air cooling instead of water based cooling lessens if not eliminates the need for a ready supply of water, making improved power generation facility 1 well suited for use in environments which lack a ready supply of water. Concurrently, use of air instead of water lessens if not eliminates the need for a local large body of water to which heat and/or chemicals need to be added. Further, water cooled condensers produce vapor plumes which may be unsightly or otherwise undesirable, but the air cooled power generation equipment 20 does not.

Cooling fans 50 may further be controlled such as with computer based controls with respect to speed and other factors to ameliorate sound and noise levels produced during the operation of improved power generation facility 1. One or more control systems 80 (not shown in FIG. 8) may be used to automate or otherwise aid in the controlling of cooling fans 50.

Figure 8A:
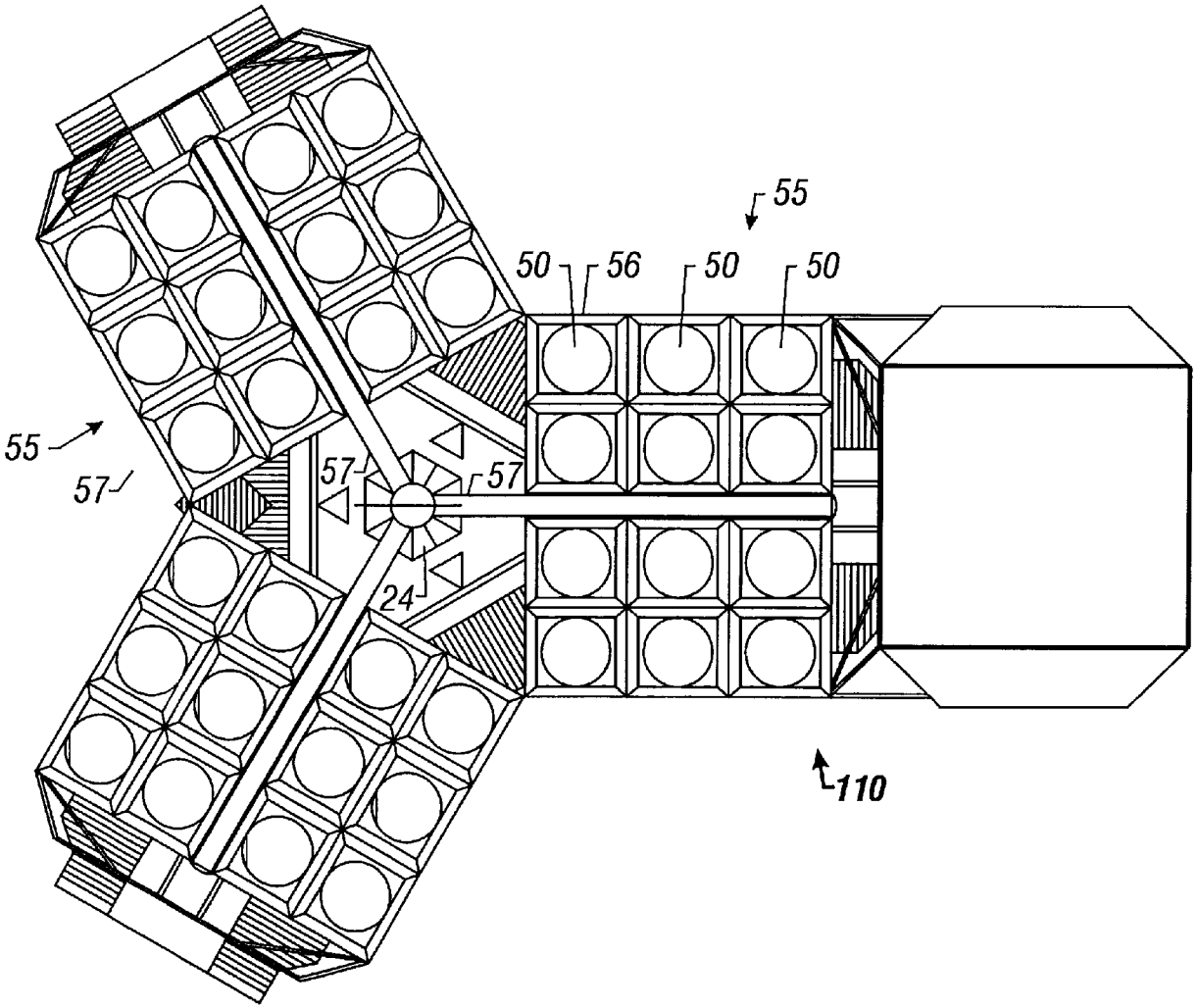
FIG. 8A is a plan view of a representative configuration of power generation facility showing placement of condenser bays with cooling fans.
Figure 8B:
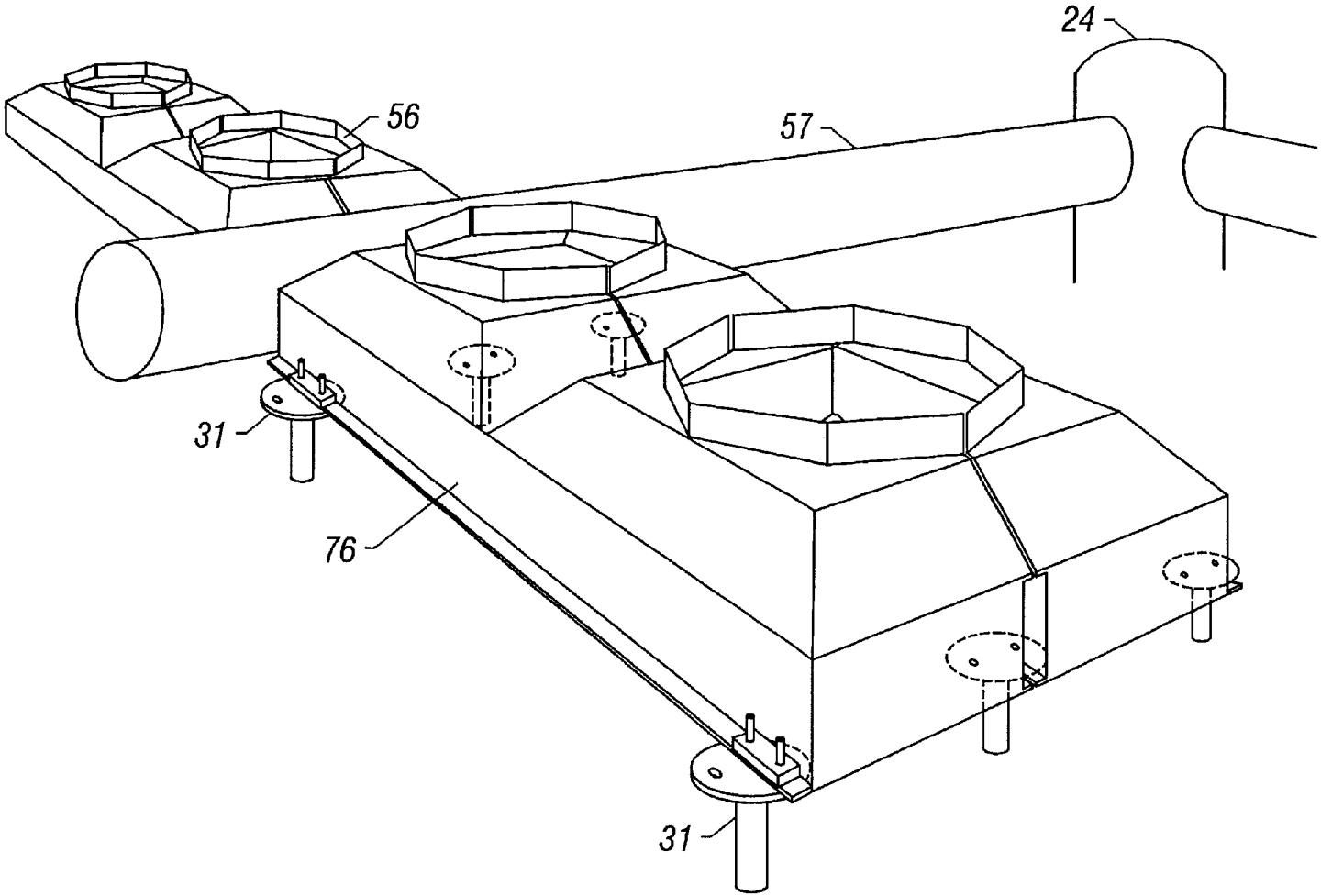
FIG. 8*b* is a side perspective view in partial cutaway showing condenser bays and isolators.
Figure 8C:
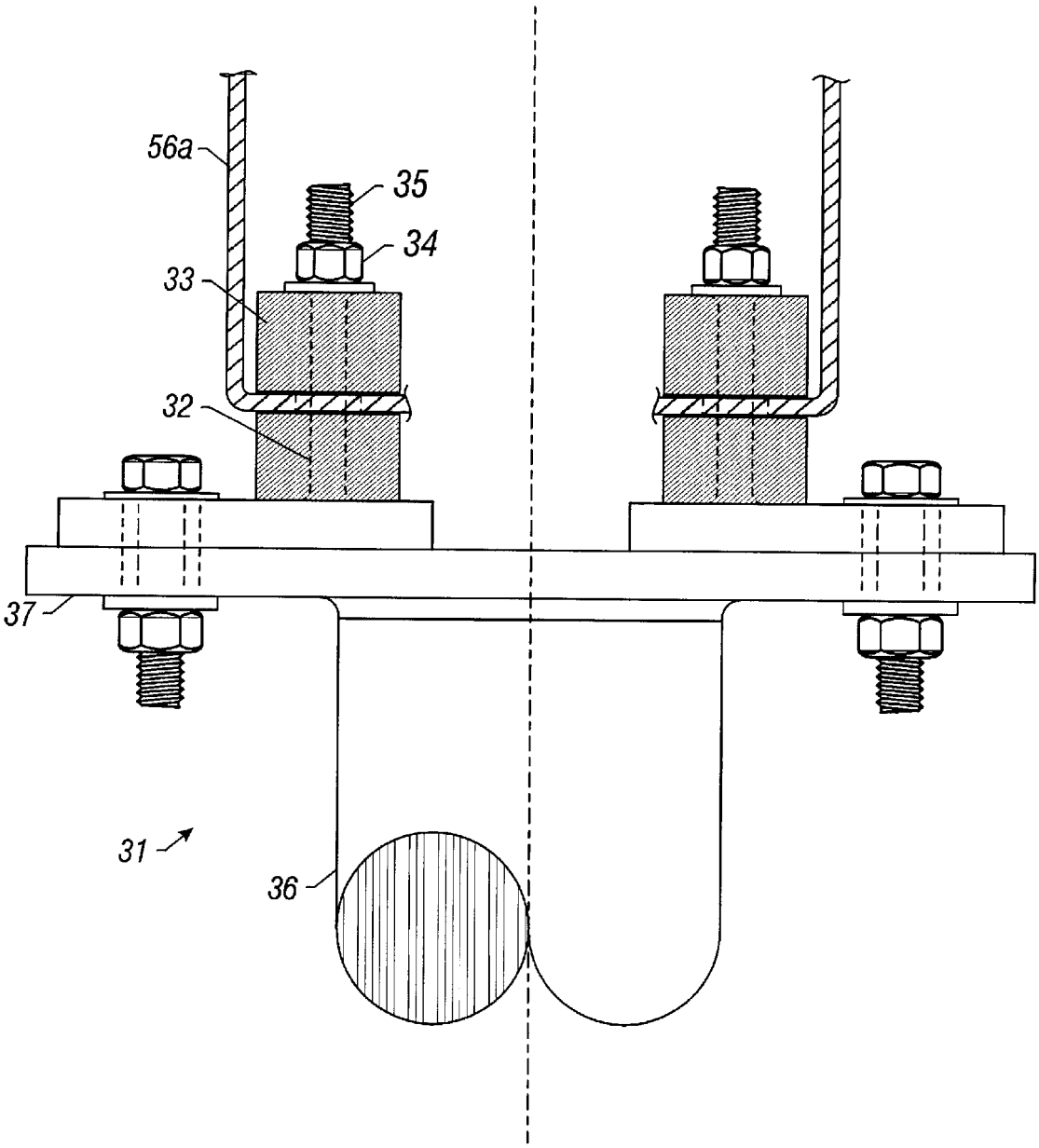
FIG. 8*c* is a side plan view of isolators.
Figure 8D:
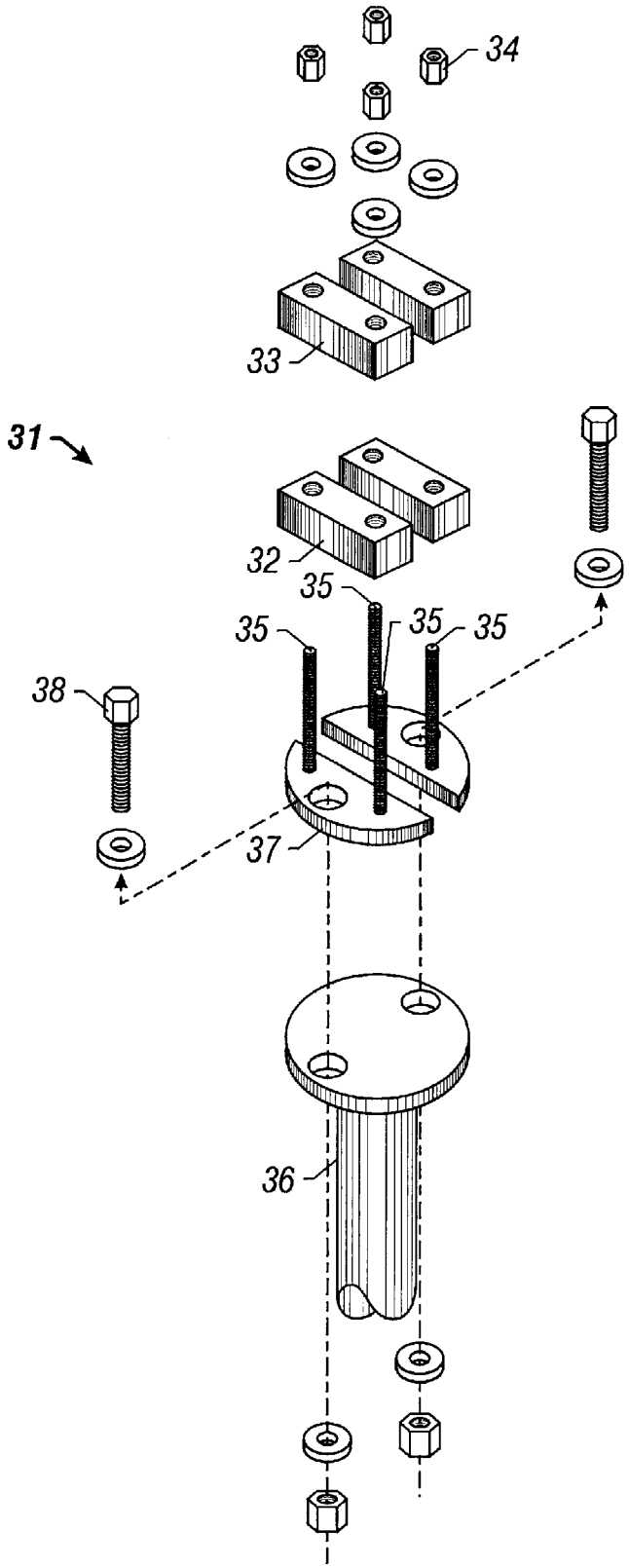
FIG. 8*d* is an exploded view of a typical isolator.

Referring now to FIG. 8*a,* a side perspective view in partial cutaway showing condenser bays and isolators, FIG. 8*b,* a side plan view of isolators, and FIG. 8*c,* an exploded view of a typical isolator, condenser bays 55 are mounted onto support structure 30 using convention means, as are well known to those in the construction arts, but are isolated from support structure 30 by isolators, generally referred to by the numeral "31." Isolators 31 may comprise isolation pads 32. In a preferred mode, one isolator pad 32 may be placed on each of two sides of condenser bay leg 56*a* which is secured between isolator pads 32 by any means known to those skilled in the construction arts such as by way of example and not limitation nuts 34 and bolts 35, welds, rivets, or any combination thereof. Isolation pads 32 may be made constructed from cork, rubber, plastic, or other suitable material and further aid in reducing noise produced by the operation of cooling fans 50.

Figure 9:
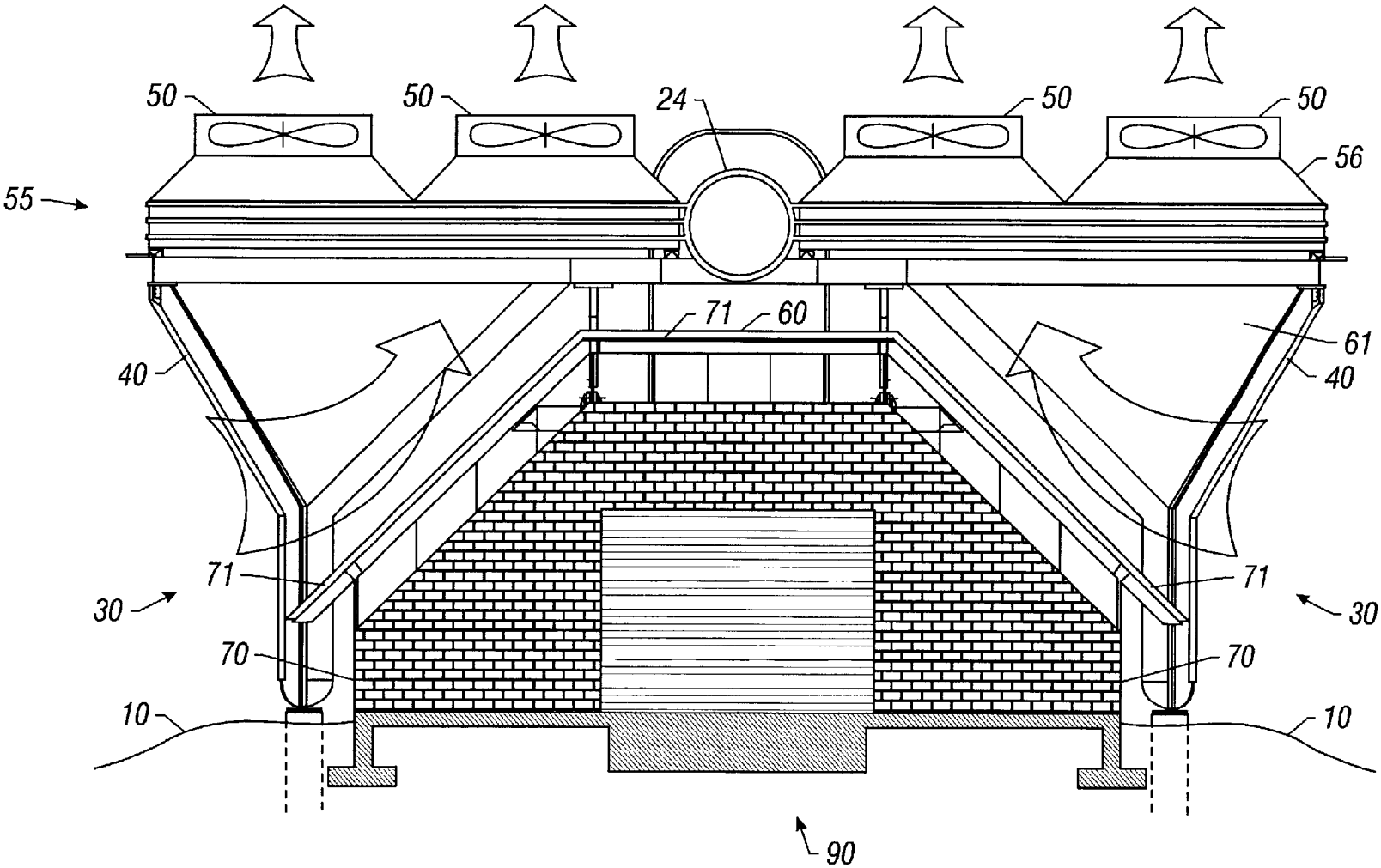
FIG. 9 is a section of a representative configuration of a modular power generation facility showing air flows through condensers mounted on a support structure.

Referring now to FIG. 9, a side view of a representative configuration of power generation facility 1 showing air flows, roof 60, walls 70, and ceiling 71 are shaped to act as one or more guide vanes 61. In a preferred embodiment, air flow is routed via guide vanes 61 through cooling fans 50 and then upward from and perpendicular to cooling fans 50, further aiding in noise control as well as promoting air availability for cooling. Housing 90, comprising walls 70, ceiling 71, and roof 60, is constructed or otherwise placed within support structure 30 such that support structure 30 substantially surrounds housing 90.

In the preferred embodiment, support structure 30 supports the dead weight load of each condenser bay 55 such that support structure 30 resists regional wind and snow loads. Further, in a preferred embodiment, tricolumn legs 40 are of a height sufficient to allow a balanced flow of aid from below. Typically, tricolumn legs 40 are between thirty to fifty feet in height with the preferred range being between forty to forty five feet.

In the preferred embodiment, walls 70 are suspended from support structure 30 and secured onto foundation 10 using any appropriate securing means such as but not limited to bolts, rivets, nails, welding, or any combination thereof. Exterior surfaces of walls 70 may be constructed of appropriate materials such as masonry or otherwise provided with a facade to blend in with the urban surrounding architecture.

Further, in the preferred embodiment, walls 70 and ceilings 71 in each wing 11, especially power wing 11*a,* may be constructed using materials that absorb and contain noise generated by power generation equipment 20. In a preferred embodiment, walls 70 are constructed of brick on an outside portion of walls 70 and sound blocking cinder block, such as will be known to those skilled in the construction arts, to the interior. Ceilings 71 may be constructed of steel or wood or any other appropriate material sufficient to provide protection from anticipated external weather events. Windows (not shown in the figures) may be placed into walls 70 or roof 60 or a combination thereof. In a preferred embodiment, windows are constructed from one-half inch thick glass and positioned near a junction between walls 70 and roof 60 to provide ambient light without presenting an increased environmental load on the interior of wings 11.

Figure 10:
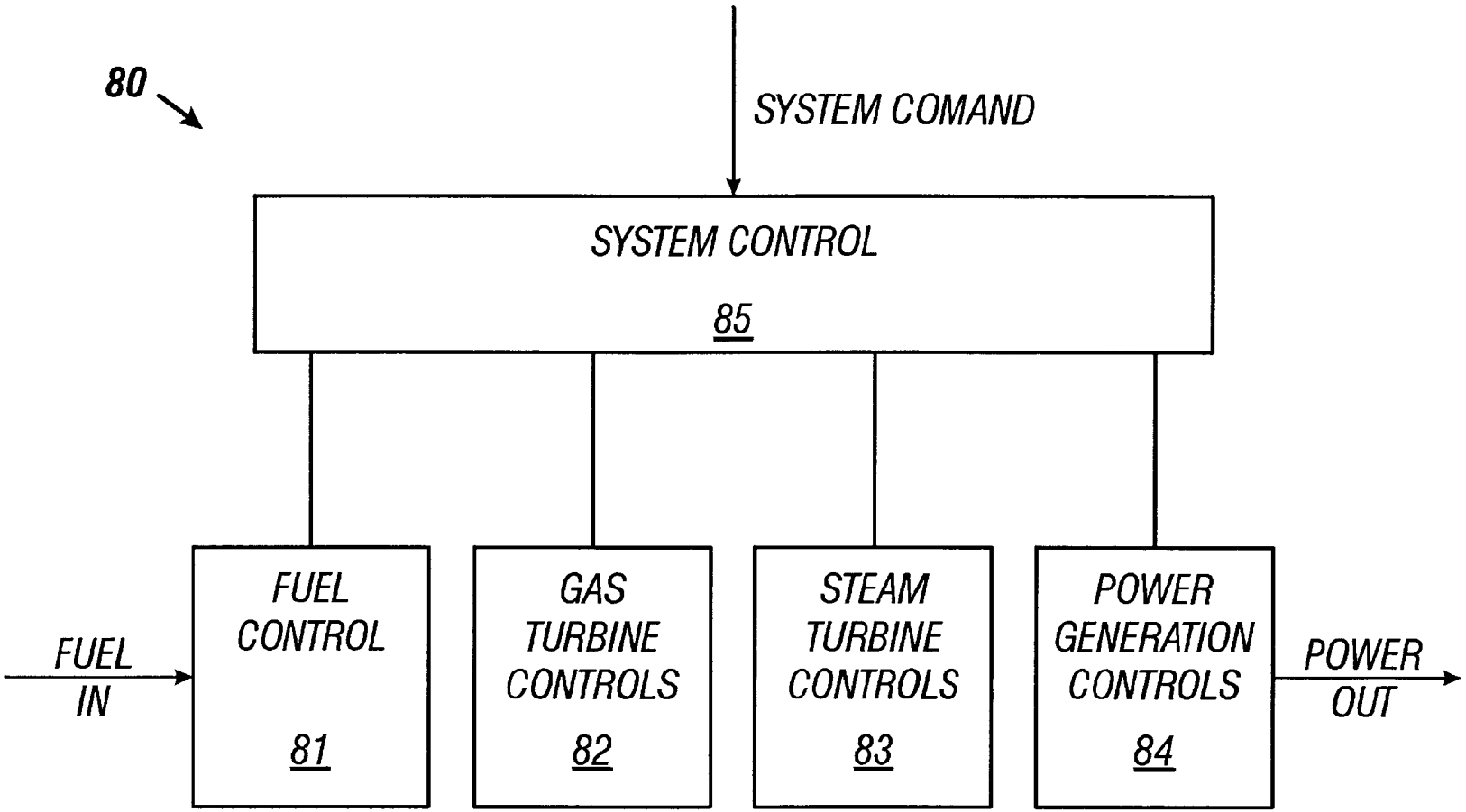
FIG. 10 is a block diagram of automated controls.

Referring now to FIG. 10, a block diagram of control systems, improved power generation facility 1 may be automated using one or more control systems 80 to further lower deployment and running costs. Control system 80 may further comprise monitors and controllers, as will be apparent to those in the control systems arts, such as by way of example and not limitation fuel controller 81, gas turbine controller 82, steam turbine controller 83, and power generation controller 84. A supervisory controller such as system controller 85 may be present to coordinate the other controllers.

Figure 11:
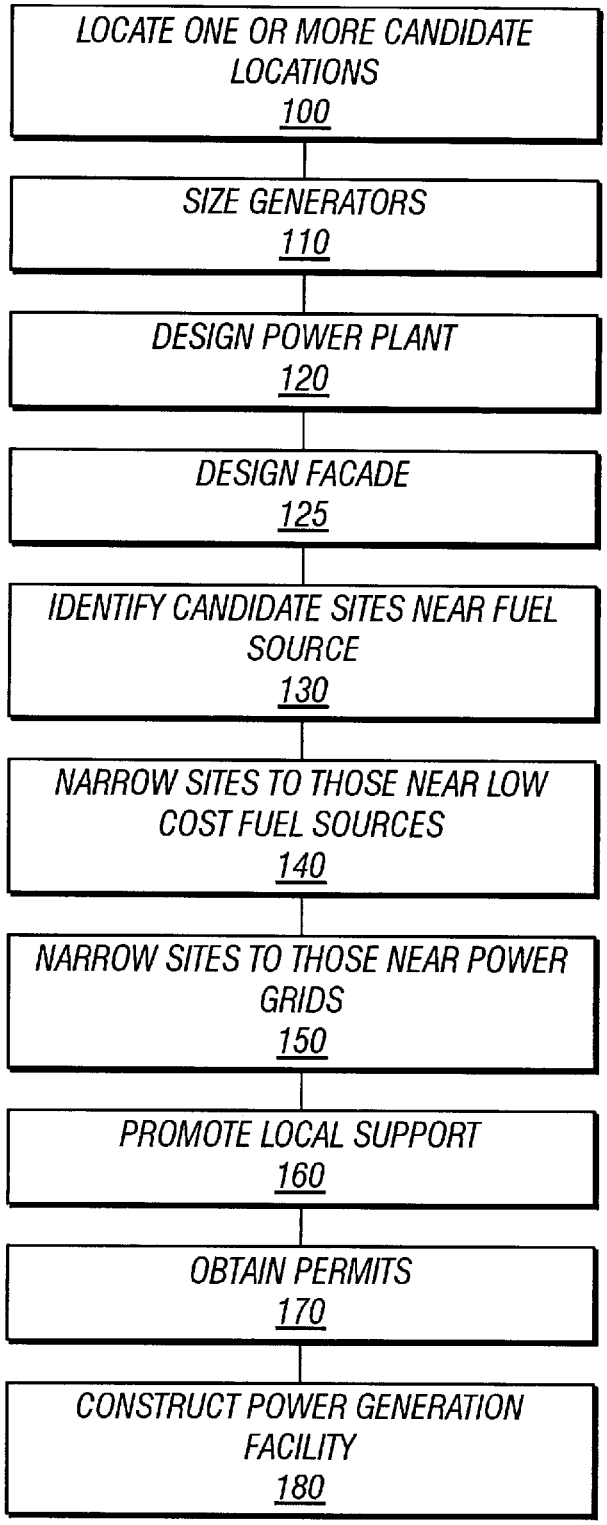
FIG. 11 is a flowchart outlining the present invention's method of site selection.
Figure 12:
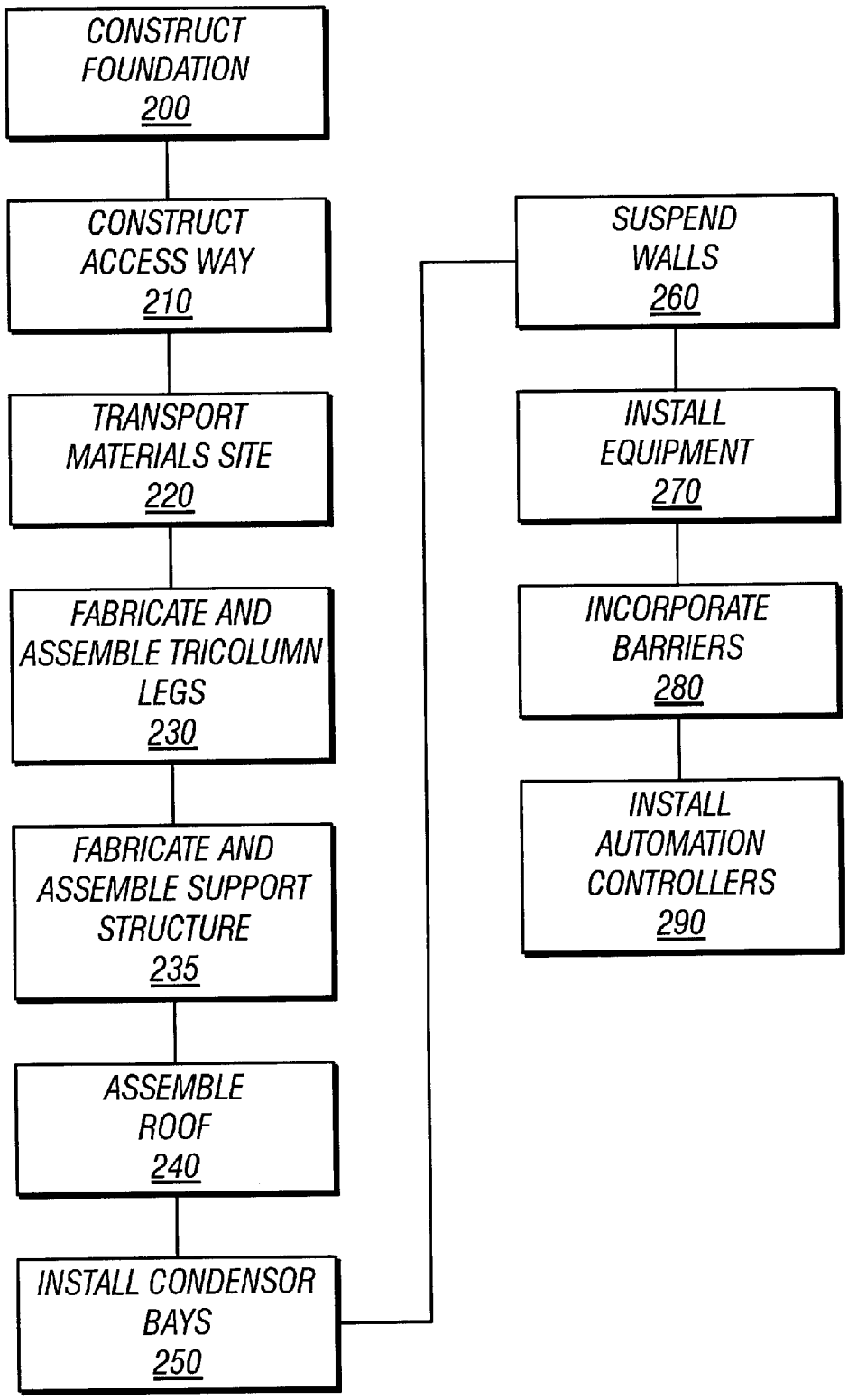
FIG. 12 is a flowchart outlining the present invention's method of construction.
Figure 13:
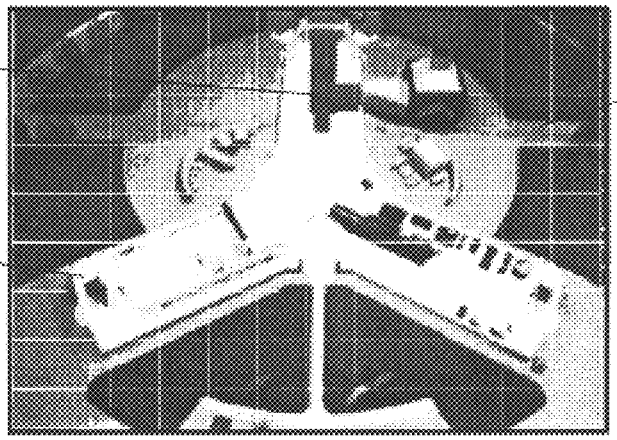
FIG. 13 is a top perspective view of a representative configuration of a modular power generation facility showing construction of a foundation.
Figure 14:
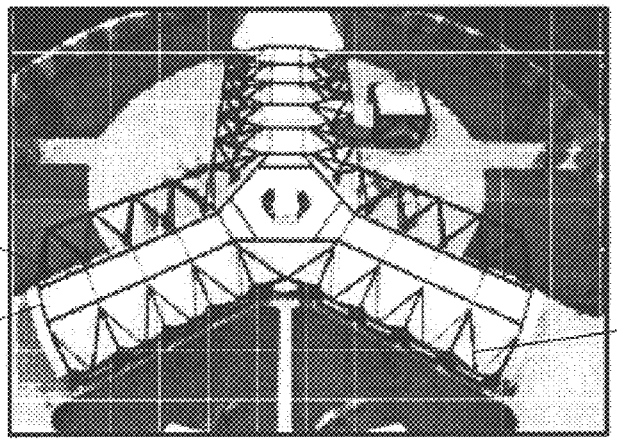
FIG. 14 is a top perspective view of a representative configuration of a modular power generation facility showing placement of tricolumn legs forming a support structure.
Figure 15:
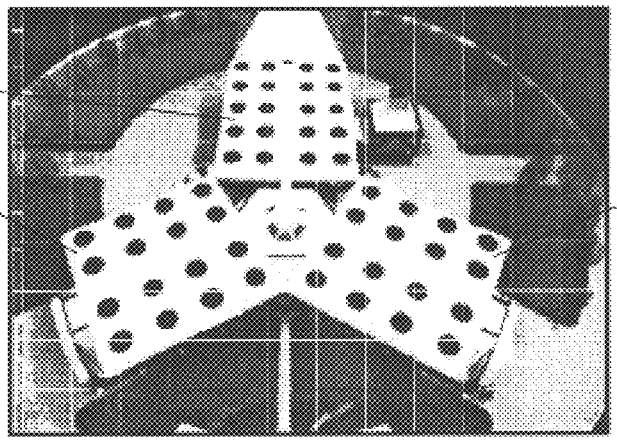
FIG. 15 is a top perspective view of a representative configuration of a modular power generation facility showing placement of condenser bays with cooling fans onto the support structure.

In the operation of the preferred embodiment, referring now to FIG. 11, a flowchart generally outlining the method of the present invention, site selection for power generation facility 1 is accomplished as outlined within FIG. 11 and more specifically detailed in Applicant's application entitled "Improved method for site selection for an power generation facility and method of construction," filed concurrently herewith and specifically incorporated herein by reference.

In general, once power requirements are determined, one or more power generators are sized 110 which will provide power appropriate for the ultimate consumers.

Having sized the power generators required, one or more housings for the one or more power generators are then designed 120, in the preferred embodiment using pre-existing modular housing designs, and a facade for the one or more housings then designed 125 which will blend visually into the general architecture and environment in which the power generation facility is located. In order to gain access to and acceptance by the local community comprising the urban center, power generation facility 1 may be modular as in the preferred embodiment, with outer shells, e.g. outer visible surfaces of walls 70 and/or roof 60, configurable in appearance to blend into the surrounding environment, both architecturally and in operation. Further, power generation facility 1 is of a smaller and more compact scale than traditional power plants. Given its smaller size, functional layout, and configurable facade, acceptance by the local community into an urban setting is enhanced. In the preferred embodiment the entire power generation facility 1, including surrounding landscaping 2, requires no more than nine square acres per module in which to be situated.

In the preferred embodiment, each power generation facility 1 is modular, allowing for prefabrication of one or more modules each capable of producing power, further leading to lower costs and more rapid implementation and construction. Further, if so required, power generation facility 1 may begin with a single physical plant module, and other modules may be added at later dates to the existing original power generation facility 1.

In this manner, given its modularity and utilization of lower cost fuels and existing power grids, the present invention may react quickly and efficiently to changing market conditions and erratic swings in prices of raw fuels and power, and participate in spot markets for power when prices rise because of a lack of fuel or power in a given area or when prices plunge because of an oversupply.

Permits for construction of the power generation facility 1 are then obtained 170, and the power generation facility constructed 180 according to its designs to provide a predetermined power generation output.

Referring now to FIG. 1 and FIGS. 12–15, in the preferred embodiment once a site is selected and requisite approvals and permits obtained, foundation 10 is constructed 200 on the selected site to withstand local conditions such as soil type, earthquake incidence, flooding, and the like. In the preferred embodiment, foundation 10 is constructed of reinforced concrete of a size and spacing appropriate to support power generation equipment 20 and local environmental conditions such as those mentioned herein above.

After or concurrent with the construction of foundation 10, access way 12 may be constructed 210 from an existing thoroughfare such as a nearby street into the physical location and up to where foundation 10 is to be laid, facilitating transportation 220 of the remaining items needed to construct improved power generation facility 1 to the onsite construction area.

Pre-fabricated tricolumn legs 40 are brought to physical the location 230 and assembled 235 in place to form supporting structure 30. Any manner of assembly may be used, as those skilled in construction arts will be aware. In the preferred embodiment, pre-fabricated tricolumn legs 40 are assembled to form support structure 30 by bolting tricolumn legs 40 to foundation 10 and to each other, obviating the need for and danger attendant to welding. After being secured to foundation 10, tricolumn legs 40 may then be individually leveled to produce a level support platform.

Roof 60, in the preferred embodiment assembled from a lightweight material such as lightweight steel or wood, is suspended or otherwise placed 240 underneath support structure 30. Additionally, roof 60 may further incorporate sound material such as lead laminated between two sheets of plastic or other materials well known to those skilled in the architectural or construction arts.

Condenser bays 55, including fans 50, are installed 250 upon support structure 30.

In the preferred embodiment, walls 70 are suspended 260 from support structure 30, and then power generation equipment 20 installed 270. In alternative embodiments, all walls 70 but for one or two may be installed to leave adequate access for placement of power generation equipment 20 into power generation facility 1.

In the prior art, construction of a power generation facility begins with the foundation and installation of power generation equipment upon the foundation, with the surrounding structures added last. In the present invention's method, and due in part to the modular nature of power generation facility 1, initially constructing access way 12, foundation 10, support structure 30, and walls 70 allows a more rapid implementation of a surrounding protective shell, further allowing installation of power generation equipment 20 even in inclement weather due to the sheltering nature of support structure 30 and walls 70 and the more tolerant access way 12 (as opposed to, for example, a dirt path).

As an additional benefit to the present invention's method of constructing an power generation facility 1, power generation equipment 20 costs—usually a highly significant and substantial portion of the overall cost of construction—can be delayed until long into the construction cycle.

When completed, power generation facility 1 may incorporate 280 barriers 2 such as but not limited to landscaping to further blend into its surroundings. Further, once completed, one or more controls for partially or fully automating control 290 of power generation facility 1 in a manner familiar to those skilled in the power generation automation arts.

Once constructed, power generation facility 1 may be brought online to meet power requirements of a local community or a power distribution grid network and taken offline when those requirements abate. Use of lower cost fuels as well as appropriate power generation equipment 20 such as gas turbine-generator set 21 and steam turbine-generator set 22 allows for start-stop operation of power generation equipment 20. This versatility allows more economic construction and operation of power generators due to the ability of improved power generation equipment 20 to ramp on and off quickly and/or produce variable amounts of power. Further, the modular approach embodied herein allows for incremental production of power as well as incremental construction of power generators.

It may be seen from the preceding description that an improved power generation facility and method have been provided.

It is noted that the embodiment of the improved power generation facility and method described herein in detail for exemplary purposes is of course subject to many different variations in structure, design, application and methodology. Because many varying and different embodiments may be made within the scope of the inventive concepts herein taught, and because many modifications may be made in the embodiment herein detailed in accordance with the descriptive requirements of the law, it is to be understood that the details herein are to be interpreted as illustrative and not in a limiting sense.

What is claimed is:

1. An improved power generation facility comprising:

a foundation of a predetermined size;

a central exhaust manifold;

a plurality of legs, each of said legs being securably fastened to at least one other of said legs and to the foundation, the legs forming a support structure;

one or more condenser bays, each of said condenser bays further comprising at least one cooling fan, the condenser bays being supported by the support structure;

power generation equipment of a predetermined size, the power generation equipment being capable of interfacing with a power distribution system, the power generation equipment further capable of utilizing a fuel source to generate power; and a housing of a predetermined size for containing the power generation equipment, the housing being suspended from the support structure, the housing further comprising at least one configurable facade.

2. The improved power generation facility of claim 1 wherein the power generation facility is air-cooled.

3. The improved power generation facility of claim 1 wherein the fuel source is natural gas.

4. The improved power generation facility of claim 3 wherein the fuel source is low-grade natural gas.

5. The improved power generation facility of claim 1 where the predetermined power generation equipment is capable of output up to around 150 megawatts.

6. The improved power generation facility of claim 1 wherein the housing is securably fastened to the foundation.

7. The improved power generation facility of claim 1 where the at least one cooling fan is situated to minimize noise from the at least one cooling fan.

8. The improved power generation facility of claim 1 further comprising a controller for variably adjusting rotation of the at least one cooling fan.

9. The improved power generation facility of claim 1 further comprising a roof wherein the roof at least partially forms one or more air corridors that act as guide vanes for inducing airflow and turning cross winds up the flow.

10. The improved power generation facility of claim 9 wherein the housing further comprises a roof, walls, and a ceiling, the roof, walls, and the ceiling at least partially forming one or more air corridors that act as guide vanes for inducing airflow and turning cross winds up the flow.

11. The improved power generation facility of claim 1 wherein the foundation comprises a plurality of wings.

12. The improved power generation facility of claim 11 wherein the plurality of wings further comprise a wing for housing power generation equipment and water treatment equipment.

13. The improved power generation facility of claim 1 wherein the foundation comprises three wings.

14. The improved power generation facility of claim 13 wherein each of the three wings is substantially similar in size and shape.

15. The improved power generation facility of claim 13 wherein the three wings are arranged at substantially equal radial intervals about a center of the foundation.

16. The improved power generation facility of claim 1 wherein the power generation equipment further comprises an interface to an electrical distribution grid.

17. The improved power generation facility of claim 16 wherein the electrical distribution grid is an intermediate electrical distribution grid.

18. The improved power generation facility of claim 1 further comprising noise abatement structures.

19. The improved power generation facility of claim 18 wherein the housing further comprises a roof, walls, and a ceiling, the roof, walls, and the ceiling at least partially forming one or more air corridors that act as guide vanes for inducing airflow and turning cross winds up the flow, and the noise abatement structures further comprise the one or more guide vanes.

20. The improved power generation facility of claim 19 wherein the noise abatement structures further comprise sound deadening material, the sound deadening material being integrated into or applied to the housing.

21. The improved power generation facility of claim 1 further comprising a central steam turbine exhaust.

22. The improved power generation facility of claim 21 wherein the condenser bays are symmetrically aligned radially from central steam turbine exhaust.

23. The improved power generation facility of claim 1 wherein at least one leg further comprises an adjustable leveler.

24. The improved power generation facility of claim 1 wherein the legs are tricolumn legs.

25. The improved power generation facility of claim 1 further comprising isolators disposed intermediate the condenser bays and the support platform.

26. The improved power generation facility of claim 25 wherein the isolators comprise cork, rubber, plastic, or a combination thereof.

27. The improved power generation facility of claim 1 wherein the legs are between thirty and fifty feet in height.

28. The improved power generation facility of claim 1 wherein the power generation equipment is capable of selectively being placed into operation by cycling the power generation on and off.

29. The improved power generation facility of claim 1 wherein the power generation equipment comprises a gas turbine-generator set and a steam turbine-generator set.

30. The improved power generation facility of claim 1 wherein the improved power generation facility is a low impact power generation facility to be constructed in or near a developed, populated area comprising ultimate consumers of power from the power generation facility.

31. The improved power generation facility of claim 30 wherein the configurable facade is constructed having an architectural appearance substantially similar to an architectural appearance in the developed, populated area comprising ultimate consumers of power from the power generation facility.

32. An improved power generation facility comprising a plurality of modular power generation facilities, each modular power generation facility further comprising:

a standardized foundation of a predetermined size;

at least one standardized condenser bay, each of said condenser bays comprising at least one cooling fan of a predetermined size;

a standardized support structure comprising a plurality of standardized legs, each of said legs being securably fastened to at least one other of said legs and to the foundation, the support structure capable of supporting the at least one standardized condenser bay;

power generation equipment of a predetermined size, the power generation equipment being capable of interfacing with a power distribution system, the power generation system further capable of utilizing a fuel source to generate power; and a standardized housing for containing the power generation equipment, the housing being suspended from the support structure, the housing further comprising at least one configurable facade.

33. The improved power generation facility of claim 32 wherein the power generation facility is air-cooled.

34. The improved power generation facility of claim 32 wherein the fuel source is natural gas.

35. The improved power generation facility of claim 32 wherein the fuel source is low-grade natural gas.

36. The improved power generation facility of claim 32 where the predetermined power generation equipment is capable of output up to around 150 megawatts.

37. The improved power generation facility of claim 32 wherein the housing is securably fastened to the foundation.

38. The improved power generation facility of claim 32 where the at least one cooling fan is situated to minimize noise from the at least one cooling fan.

39. The improved power generation facility of claim 32 further comprising a controller for variably adjusting rotation of the at least one cooling fan.

40. The improved power generation facility of claim 32 wherein the roof structure further at least partially forms one or more guide vanes for inducing airflow and turning cross winds up the flow.

41. The improved power generation facility of claim 32 wherein the foundation comprises a plurality of wings.

42. The improved power generation facility of claim 41 wherein the foundation comprises three wings.

43. The improved power generation facility of claim 42 wherein each of the three wings is substantially similar in size and shape.

44. The improved power generation facility of claim 41 wherein the plurality of wings are arranged at substantially equal radial intervals about a center of the foundation.

45. The improved power generation facility of claim 41 wherein the plurality of wings further comprise a wing for housing power generation equipment and water treatment equipment.

46. The improved power generation facility of claim 32 wherein the power generation equipment further comprises an interface to an electrical distribution grid.

47. The improved power generation facility of claim 46 wherein the electrical distribution grid is an intermediate electrical distribution grid.

48. The improved power generation facility of claim 32 wherein the improved power generation facility is a low impact power generation facility to be constructed in or near a developed, populated area comprising ultimate consumers of power from the power generation facility.

49. The improved power generation facility of claim 48 wherein the configurable facade is constructed having an architectural appearance substantially similar to an architectural appearance in the area comprising ultimate consumers in which the improved power generation facility is situated.

50. The improved power generation facility of claim 32 further comprising noise abatement structures.

51. The improved power generation facility of claim 50 wherein the noise abatement structures comprise a roof structure configuration at least partially forming one or more guide vanes for inducing airflow and turning cross winds up the flow.

52. The improved power generation facility of claim 50 wherein the noise abatement structures further comprise sound deadening material, the sound deadening material being integrated into or applied to the housing.

53. The improved power generation facility of claim 32 further comprising a central steam turbine exhaust.

54. The improved power generation facility of claim 53 wherein the condenser bays are symmetrically aligned radially from the central steam turbine exhaust.

55. The improved power generation facility of claim 32 wherein at least one leg further comprises an adjustable leveler.

56. The improved power generation facility of claim 32 wherein the legs are tricolumn legs.

57. The improved power generation facility of claim 32 further comprising isolators disposed intermediate the condenser bays and the support structure.

58. The improved power generation facility of claim 57 wherein the isolators comprise cork, rubber, plastic, or a combination thereof.

59. The improved power generation facility of claim 32 wherein the legs are between thirty and fifty feet in height.

60. The improved power generation facility of claim 32 wherein the power generation equipment is capable of being cycled on and off.

61. The improved power generation facility of claim 32 wherein the power generation equipment comprises a gas turbine-generator set and a steam turbine-generator set.

62. An improved method of implementing an improved power generation facility comprising the steps of:

determining a size for a foundation for a physical location;

creating the foundation at the physical location;

installing a central exhaust manifold on the foundation;

securably fastening each of a plurality of legs to the foundation and to at least one other leg, the legs forming a supporting structure capable of supporting a roof structure and one or more condenser bays;

installing the one or more condenser bays onto the support structure, each condenser bay further comprising at least one cooling fan;

connecting each of the condenser bays to the central exhaust manifold;

installing a housing for containing power generation equipment of a predetermined size by suspending the housing from the support structure;

installing a configurable facade onto outer surfaces of the housing;

installing power generation equipment of a predetermined size into the housing and onto the foundation;

connecting the power generation equipment to a fuel source; and connecting the power generation equipment to a power distribution grid.

63. The improved method of claim 62 further comprising the steps of:

powering up the power generation equipment upon demand;

producing an amount of power until demand ceases; and powering down the power generation equipment.

* * * * *